US007607913B2

(12) United States Patent
Wells

(10) Patent No.: US 7,607,913 B2
(45) Date of Patent: Oct. 27, 2009

(54) CO CONTROLLER FOR A BOILER

(75) Inventor: Charles H. Wells, Emerald Hills, CA (US)

(73) Assignee: OSIsoft, Inc., San Leandro, CA (US)

( * ) Notice: Subject to any disclaimer, the term of this patent is extended or adjusted under 35 U.S.C. 154(b) by 193 days.

(21) Appl. No.: 11/546,523

(22) Filed: Oct. 10, 2006

(65) Prior Publication Data

US 2007/0111148 A1 May 17, 2007

Related U.S. Application Data

(60) Provisional application No. 60/731,155, filed on Oct. 27, 2005.

(51) Int. Cl.
*F23N 1/02* (2006.01)

(52) U.S. Cl. ..... 431/12; 431/2; 700/274

(58) Field of Classification Search ..... 431/10, 431/12, 2; 700/274

See application file for complete search history.

(56) References Cited

U.S. PATENT DOCUMENTS 3,184,686 A * 5/1965 Stanton ..... 327/518
3,469,828 A * 9/1969 Lane ..... 432/17
3,880,348 A * 4/1975 Salihbegovic et al. ..... 700/46
4,033,712 A * 7/1977 Morton ..... 431/90
4,054,408 A * 10/1977 Sheffield et al. ..... 431/12
4,162,889 A * 7/1979 Shigemura ..... 431/76
4,362,269 A * 12/1982 Rastogi et al. ..... 236/14
4,362,499 A * 12/1982 Nethery ..... 431/12
4,423,487 A * 12/1983 Buckenham et al. ..... 702/182
4,516,929 A * 5/1985 Hiroi et al. ..... 431/12
4,531,905 A * 7/1985 Ross ..... 431/12
4,666,457 A * 5/1987 Hayes et al. ..... 44/281
4,749,122 A * 6/1988 Shriver et al. ..... 236/14
4,846,410 A * 7/1989 Jewett et al. ..... 241/31
5,070,246 A * 12/1991 Durham et al. ..... 250/373
5,205,253 A * 4/1993 Shelef et al. ..... 123/198 D
5,222,887 A * 6/1993 Zabielski, Sr. ..... 431/12
5,226,920 A * 7/1993 Andreasson ..... 123/436
5,248,617 A * 9/1993 De Haan ..... 436/137
5,280,756 A * 1/1994 Labbe ..... 110/191
5,764,544 A * 6/1998 Sheldon ..... 703/2
5,790,420 A * 8/1998 Lang ..... 700/287
5,827,979 A * 10/1998 Schott et al. ..... 73/861.357
5,993,049 A * 11/1999 Sheldon ..... 703/9
6,095,793 A * 8/2000 Greeb ..... 431/12
6,120,173 A * 9/2000 Bonissone et al. ..... 366/8
6,388,447 B1 * 5/2002 Hall et al. ..... 324/426
6,499,412 B2 * 12/2002 Cochran et al. ..... 110/346
6,507,774 B1 * 1/2003 Reifman et al. ..... 700/274
6,584,429 B1 * 6/2003 Lang ..... 702/182
6,714,877 B1 * 3/2004 Lang ..... 702/32
6,810,358 B1 * 10/2004 Lang et al. ..... 702/182
2002/0167326 A1 * 11/2002 Borden et al. ..... 324/752
2004/0180203 A1 * 9/2004 Yadav et al. ..... 428/402

* cited by examiner

*Primary Examiner*—Kenneth B Rinehart
*Assistant Examiner*—Jorge Pereiro
(74) *Attorney, Agent, or Firm*—Lumen Patent Firm

(57) ABSTRACT

A CO controller is used in a boiler (e.g. those that are used in power generation), which has a theoretical maximum thermal efficiency when the combustion is exactly stoichiometric. The objective is to control excess oxygen (XSO2) so that the CO will be continually on the "knee" of the CO vs. XSO2 curve.

17 Claims, 1 Drawing Sheet

CO CONTROLLER FOR A BOILER

RELATED APPLICATIONS

This application claims priority under 35 U.S.C. §119(e) to provisional application No. 60/731,155 filed on Oct. 27, 2005 titled "CO Controller for a Boiler."

FIELD

The invention relates to boilers, and, more particularly, to closed loop carbon monoxide controllers for boilers.

BACKGROUND

Boilers (e.g. those that are used in power generation) have a theoretical maximum thermal efficiency when the combustion is exactly stoichiometric. This will result in the best overall heat rate for the generator. However, in practice, boilers are run "lean"; i.e., excess air is used, which lowers flame temperatures and creates an oxidizing atmosphere which is conducive to slagging (further reducing thermal efficiency). Ideally the combustion process is run as close to stoichiometric as practical, without the mixture becoming too rich. A rich mixture is potentially dangerous by causing "backfires". The objective is to control excess oxygen (XSO2) so that the CO will be continually on the "knee" of the CO vs. XSO2 curve.

SUMMARY

A method for computing an excess oxygen setpoint for a combustion process in real time is described.

DESCRIPTION

Figure 1:
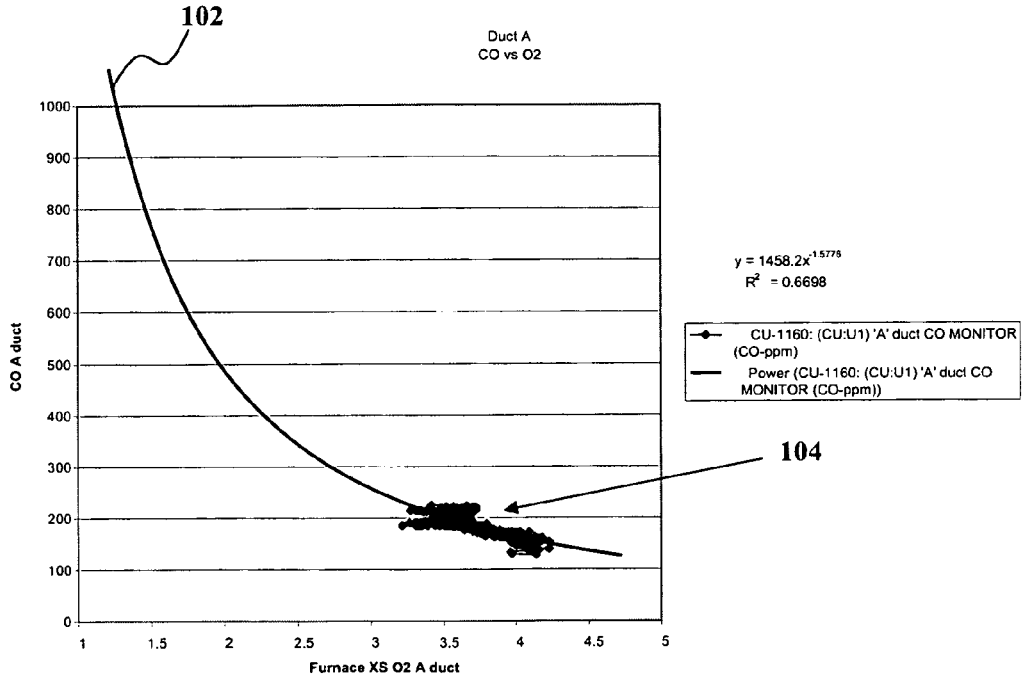
FIG. 1 shows an example of a CO vs. XSO2 curve.

One objective is to control excess oxygen (XSO2) so that the CO will be continually on the "knee" of the CO vs. XSO2 curve. This will result in the best overall heat rate for the generator. The basic theory behind this premise is that maximum thermal efficiency occurs when the combustion is exactly stoichiometric. However, in practice boilers are run "lean"; i.e., excess air is used, lowering flame temperatures, and creating an oxidizing atmosphere which is close to stoichiometric as practical, without the mixture becoming too rich, potentially becoming dangerous by causing "backfires".

The "knee" of the curve is defined where the slope of the curve is fairly steep. Users can select the slope to be either aggressive or conservative. A "steep" slope is very aggressive (closer to stoichiometric), a "shallow" slope is more conservative (leaner burn).

In most cases, operators run the boilers at very low or nearly zero CO. This is to prevent "puffing" in the lower sections of the economizer.

FIG. 1 shows an example of a CO vs. XSO2 curve. Shown are a power law curve 102 of CO vs XSO2 and real time data 104. The x-axis is the percentage of XSO2. The y-axis is CO in ppm.

This document describes how to run the combustion process under closed loop control to achieve best heat rate under all loading conditions and large variations in coal quality. The method is as follows:

One embodiment using the power law curves is described. The invention is not limited to power law curves. First, in real time, compute the power law curve 102 of CO vs XSO2. An example is shown in FIG. 1. This is done in a moving window of real time data 104, typically the last 30 minutes of operating data. Filtering of the data 104 may be applied during the fitting process. A moving window maximum likelihood fitting process may be used to create the coefficients in the power law curve fit. This method works for any type of fitted function.

Second, an operator selects a slope target. For example, −300 ppm CO/XSO2 may be used. With this exemplary setting, for each one percent reduction in O2 there will be an increase in CO of 300 ppm.

Third, at each calculation interval, the best setpoint of O2 is determined by solving the first derivative power law curve, for the selected "derivative." This becomes the new setpoint for the O2 controller. In the case where the fitted curve is not differentiable analytically, the derivative can be found by convention numerical differentiation.

Fourth, the sensitivity analyses are done on the alpha and beta coefficients.

Using the data shown in FIG. 1, an exemplary power law fit is given by:

$$y=\alpha x^{\beta} \qquad \text{Eq. 1}$$

$$dy/dx=\gamma=\gamma=\alpha\beta x^{\beta-1} \qquad \text{Eq. 2}$$

where $\alpha$=1458.2, $\beta$=−1.5776, y=CO, x=XSO2, and $\gamma$ is the slope of the power law curve. For any value of slope, there is a unique value of x.

These parameters are estimated using CO and XSO2 data in the moving window. The window could be typically from about 5 minutes to one hour. The formulation is as follows:

$$ln(y)=ln(\alpha)+\beta ln(x) \qquad \text{Eq. 3}$$

Let $p_1=\ln(\alpha)$, $p_2=\beta$, $z(t)=\ln(y(t))$, and $w(t)=\ln(x(t))$, where t=time. We will have the values of x and y at time t=0, t=−1, t=−2, . . . , t=−n, where n is the number of past samples used in the moving window. Then we can write the following equations:

$$z(0)=1*p_1+w(0)*p_2$$

$$z(-1)=1*p_1+w(-1)*p_2$$

$$z(-n)=1*p_1+w(-n)*p_2 \qquad \text{Eqs. 4}$$

These may be written in vector matrix notation as follows:

$$z=Ap \qquad \text{Eq. 5}$$

where the A matrix is a (n×2) matrix as follows:

$$A=\begin{bmatrix} 1 & w(0) \\ 1 & w(-1) \\ 1 & w(-2) \\ \vdots & \vdots \\ 1 & w(-n) \end{bmatrix}, \text{ and}$$

p is a vector as shown below:

$$p=\begin{bmatrix} p_1 \\ p_2 \end{bmatrix}$$

The solution is:

$$\hat{p}=[A^TA]^{-1}A^Tz \quad \text{Eq. 6}$$

The resulting parameters are:

$$\hat{\alpha}=\exp(\hat{p}_1) \quad \text{Eq. 7}$$

$$\hat{\beta}=\hat{p}_2 \quad \text{Eq. 8}$$

The control equation is found by solving Eq. 2 for the value of x, resulting in:

$$x_T=\left(\frac{\alpha\beta}{\gamma}\right)^{\left(\frac{1}{1-\beta}\right)} \quad \text{Eq. 9}$$

We next look at the sensitivity of $x_t$. The total derivative is written as:

$$\Delta x_T=\left[\left(\frac{\alpha}{\beta}\right)^{\left(\frac{1}{1-\beta}\right)}+\left(\frac{1}{1-\beta}\right)\left(\frac{\alpha\beta}{\gamma}\right)^{\left(\frac{\beta}{1-\beta}\right)}\right]\delta\beta+\left(\frac{\beta}{\gamma}\right)^{\left(\frac{1}{1-\beta}\right)}\delta\alpha \quad \text{Eq. 10}$$

Thus for any variation in the parameters, one can calculate in advance the effect on the target XSO2. Thus for every change in the computed parameters, the sensitivity equation is used to determine the effect on the new proposed XSO2 setpoint.

For the data shown in FIG. 1, and a value of $\gamma=-500$, the optimal setpoint of XSO2 is 1.8 percent.

Note: one aspect of the invention is that the "now" value of CO may not be directly used to find the best XSO2 setpoint, rather the past n values of CO and XSO2. This is unique compared to other systems that have been used for control of CO.

It will be apparent to one skilled in the art that the described embodiments may be altered in many ways without departing from the spirit and scope of the invention. Accordingly, the scope of the invention should be determined by the following claims and their equivalents.

What is claimed is:

1. A method of controlling excess oxygen in a combustion process in a boiler, the method comprising:

(a) having data comprising carbon monoxide concentration and excess oxygen measurements;

(b) fitting a curve for said carbon monoxide concentration measurements versus said excess oxygen measurements, wherein said fitting relies on one or more fit parameters, and wherein the values of said one or more fit parameters are found by said fitting;

(c) determining an excess oxygen setpoint for said combustion process of said boiler based on said one or more fit parameters; and (d) adjusting said excess oxygen setpoint for said combustion process of said boiler to said determined excess oxygen setpoint, wherein said combustion process uses carbon based fuel.

2. The method of claim 1, wherein said excess oxygen and carbon monoxide concentration measurements are fitted in a moving window data store.

3. The method of claim 2 further comprising calculating a sensitivity to said one or more fit parameters of said fitted curve based on the moving window data store.

4. The method of claim 2, where the moving window data store records data for a time range between 5 and 60 minutes.

5. The method of claim 1, wherein the carbon based fuel is from a group consisting of coal, natural gas, oil, hog fuel, grass, and animal waste.

6. The method of claim 1, wherein a first derivative of said fitted curve is used to determine to said excess oxygen setpoint.

7. The method of claim 6, wherein said derivative is computed analytically.

8. The method of claim 6, wherein said derivative is computed numerically.

9. The method of claim 6, wherein said excess oxygen setpoint is determined based on an operator-selected target slope and said one or more fit parameters.

10. The method of claim 1, wherein said fitting said curve is accomplished in real time.

11. The method of claim 1, wherein said fitted curve is a power law curve of the form $y=\alpha x^{\beta}$, wherein y is the carbon monoxide concentration, wherein x is the excess oxygen, and wherein $\alpha$ and $\beta$ are said fit parameters.

12. The method of claim 11, further comprising calculating a derivative of said power law curve, wherein said excess oxygen setpoint is determined based on $\alpha$, $\beta$, and an operator-selected target slope.

13. The method of claim 12, wherein $\gamma$ is said operator-selected target slope, and wherein said determined excess oxygen setpoint is equal to $(\alpha\beta/\gamma)^{1/(1-\beta)}$.

14. The method of claim 11, further comprising calculating a sensitivity of said excess oxygen setpoint to said fit parameters of said power law curve.

15. The method of claim 14, wherein said sensitivity of said excess oxygen setpoint is equal to:

$$[(\alpha/\beta)^{1/(1-\beta)}+\{1/(1-\beta)\}(\alpha\beta/\gamma)^{\beta/(1-\beta)}]\delta\beta+[\beta/\gamma]^{1/(1-\beta)}\delta\alpha.$$

16. The method of claim 1, further comprising plotting said carbon monoxide measurements versus said excess oxygen measurements.

17. The method of claim 16, further comprising plotting said fitted curve on said plot of said carbon monoxide measurements versus said excess oxygen measurements.

* * * * *